United States Patent [19]

Loegel, Jr.

[11] Patent Number: 4,624,326

[45] Date of Patent: Nov. 25, 1986

[54] PROCESS AND APPARATUS FOR CUTTING ROCK

[76] Inventor: Charles Loegel, Jr., 27, rue du Chateau, F-67340 Lichtenberg, France

[21] Appl. No.: 711,497

[22] Filed: Mar. 14, 1985

[51] Int. Cl.[4] ..... E21B 7/18

[52] U.S. Cl. ..... 175/67; 175/90; 299/17

[58] Field of Search ..... 175/67, 90; 299/17; 51/410, 439

[56] References Cited

U.S. PATENT DOCUMENTS

| | | | |
|---|---|---|---|
| 287,909 | 11/1883 | Cook | 299/17 |
| 671,429 | 4/1901 | Bacon | 175/67 |
| 2,089,597 | 8/1937 | Carter | 51/439 |
| 2,449,672 | 5/1947 | Rich | 51/439 |
| 3,576,221 | 4/1971 | Hasiba | 175/67 |
| 3,873,156 | 3/1975 | Jacoby | 299/17 |
| 4,319,784 | 3/1982 | Claringbull | 175/67 |

FOREIGN PATENT DOCUMENTS 2027776 2/1980 United Kingdom .

*Primary Examiner*—James A. Leppink
*Assistant Examiner*—Terry Lee Melius
*Attorney, Agent, or Firm*—Robbins & Laramie

[57] ABSTRACT

A process is disclosed for cutting rock by means of discharging a medium under high pressure from a nozzle head at a fixed oscillating angle. A nozzle head on the end of the pressure hose is set in a freely pulsating movement through the discharge of a medium under high pressure. The movement of the nozzle head is controlled by a guide with stops. An apparatus for carrying out this process is also disclosed. The apparatus comprises a suitable nozzle head on a delivery line 1 for discharging a medium under high pressure and with a fixed oscillating angle and a guide 6 with stops 4. A flexible high-pressure hose is used as the delivery line 1.

15 Claims, 3 Drawing Figures

PROCESS AND APPARATUS FOR CUTTING ROCK

BACKGROUND OF THE INVENTION

1. Field of the Invention

The invention relates to a process and an apparatus for cutting rock by means of discharging a medium under high pressure from a nozzle head at a fixed oscillating angle. The apparatus contains a suitable nozzle head on a delivery line for a medium which is discharged under high pressure and with a fixed oscillating angle.

2. Description of the Prior Art

A method and apparatus of this type are known. Great Britian Published Application No. 2 027 776A describes the cutting of solid bodies, e.g., from concrete, with reinforcement or from the surface layer of a street. However, this technique is not suitable for effectively and economically cutting rock from quarries into blocks of different useful sizes.

Rock has previously been cut by extracting blocks from the native standing rock through blasting and by cutting these blocks, for example, with diamond saws, during which much rubble is produced.

It is also known, for example, to advance in the rock through a combination of mechanical devices in conjunction with water jets under high pressure (*Carrieres et Materiaux* No. 215, November/December 1983, pp. 44–46). Moreover, a method is also known of imparting a rotation to a nozzle head by means of water under high pressure supplied through a rigid lance, in order to achieve a drilling effect. The disadvantage of this prior art is that it is possible only to either drill holes or to make only cuts of little depth.

In contrast to this, the object of the invention is to provide a process and an apparatus for making cuts of any depth and length or width and at any angle in rock. It is also an object of the invention to prevent cracking of the rock which is to be extracted. Such cracking occurs, for example, during extraction by means of blasting.

SUMMARY OF THE INVENTION

This object is achieved, according to the invention, by means of the process and the apparatus of the type previously mentioned. In the process, a nozzle head on the end of a pressure hose is set in a freely pulsating movement through the discharge of a medium under high pressure. The movement of the nozzle head is controlled by a guide with stops. The apparatus for performing this method has a flexible high-pressure hose as the delivery line to a nozzle head and a guide with stops. The working pressure suitable for this purpose is, for example, between 400 and 3,600 bar, but work is preferably carried out at approximately 600 bar. The pressure also has an influence on the working speed, that is, on the speed of movement of the nozzle head.

For practical reasons, water is preferably used as the medium under high pressure, but it is also possible to use compressed air or compressed air together with solid particles and, if appropriate, water. Examples of solid particles are sand, quartz sand or iron shot.

The apparatus according to the invention for carrying out this process is explained in more detail below with reference to the Figures.

DETAILED DESCRIPTION OF THE INVENTION

Figure 1:
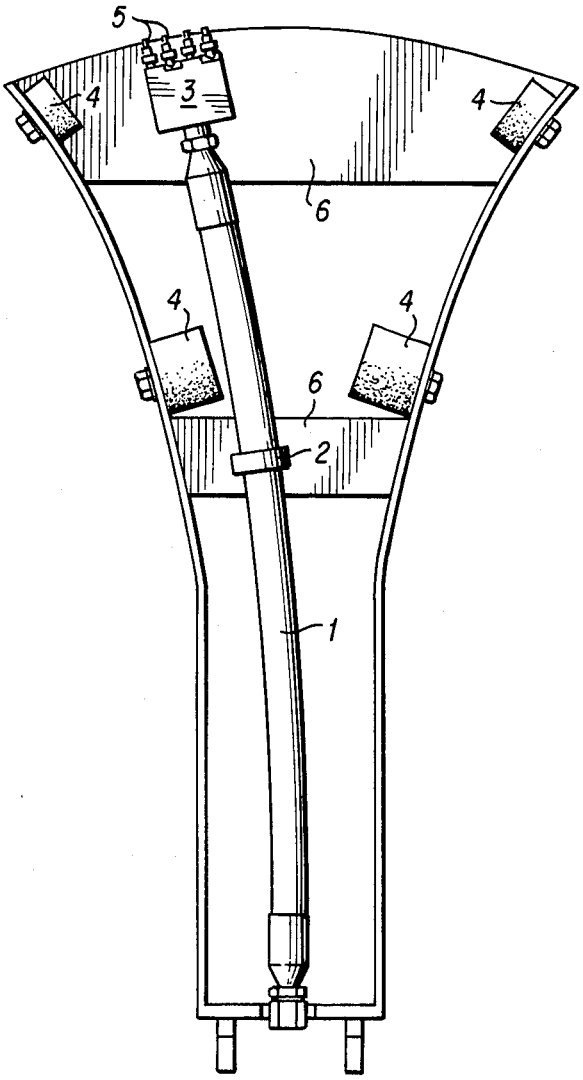
FIG. 1 shows a plan of the apparatus in section.
Figure 2:
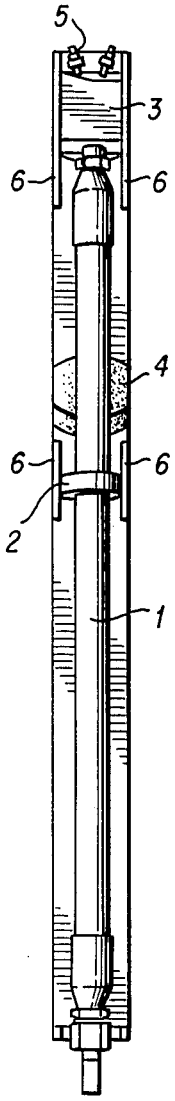
FIG. 2 shows a side view of the apparatus in section.
Figure 3:
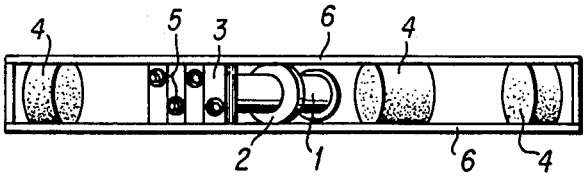
FIG. 3 shows a front view of the apparatus according to the invention.

The apparatus according to the invention has a delivery line 1, with a nozzle head 3 and nozzles 5. Preferably, the delivery line 1 is a flexible high-pressure hose. The apparatus also has a guide 6 with stops 4. To prevent excessive wear of the delivery line 1 when the apparatus is in operation, it is preferred that the delivery line 1 has a guide 2. Guide 2, together with the nozzle head 3 and in interaction with the guide 6, results in a controlled beating movement or oscillation of the delivery line 1 and nozzle head 3 between the stops 4.

The nozzle head 3 with the nozzles 5, which can assume different angles relative to the longitudinal axis of the delivery line 1, represents the state of the art and can be designed according to the requirements of the rock to be cut. Thus, where soft rock is concerned, it is sufficient to allow the nozzles 5 to stand at a relatively small angle in relation to the axis. However, where hard rock is concerned, a larger angle will be selected, to make the cutting width such that the guide 6 can follow up in the cut.

The stops 4 consist of an elastic material which can take the form of rubber blocks or even springs. By means of these stops 4, it is possible to insure longer useful life, especially of the guide 6, in comparison with an embodiment without such stops.

As illustrated in the Figures, the guide 6 can consist of a metal frame, but it can also have other embodiments; for example, that of a sleeve-like reinforcement through which the material removed as a result of the cutting operation can flow off together with the pressure medium.

With the apparatus of the invention, it has now become possible to make cuts of practically any depth and at any angle in the rock depending on the angular position of the guide 6. These cuts can be made without exposing the rock to strong vibrations which promote cracking and which would result in an increased rejection rate of the rock during subsequent processing.

What is claimed is:

1. A process for cutting rock which comprises discharging a medium under high pressure against said rock from a nozzle head on the free end of a single, flexible delivery line contained within and attached to the inlet end of a guide having stops, oscillating said nozzle head and said delivery line in a sweeping movement between said stops through the discharge of said medium itself directly through the delivery line and nozzle head.

2. The process of claim 1 wherein said medium is conveyed to said nozzle head through a flexible high-pressure hose.

3. The process of claim 2 wherein water is used as said medium.

4. The process of claim 2 wherein air is used as said medium.

5. The process of claim 4 wherein solid particles are used with said air.

6. The process of claim 5 wherein water is used with said solid particles and air.

7. The process of claim 1 wherein water is used as said medium.

8. The process of claim 1 wherein air is used as said medium.

9. The process of claim 8 wherein solid particles are used with said air.

10. The process of claim 9 wherein water is used with said solid particles and air.

11. An apparatus for cutting rock which comprises a guide having stops and a nozzle head on the free end of a single, flexible delivery line contained within said guide, the other end of said delivery line being fixedly attached to the inlet end of said guide, the apparatus discharging a medium under high pressure through said delivery line and said nozzle head, said delivery line and said nozzle head being driven at a fixed oscillating angle between said stops by the discharge of the medium itself directly through the delivery line and nozzle head.

12. The apparatus of claim 11 wherein said delivery line has a guide.

13. The apparatus of claim 12 wherein said delivery line is a flexible high-pressure hose.

14. The apparatus of claim 11 wherein said delivery line is a flexible high-pressure hose.

15. A process for making cuts of about any depth and length in rock without cracking of the rock by impinging a reciprocatingly sweeping jet of high-pressure medium onto the rock, in which a jet of a high-pressure medium from a nozzle movable to and fro at a pivoting angle which opens in the direction of the jet and connected to a medium source via a flexible supply line is directed towards the rock or the like, characterized in that the flexible supply line with the nozzle is set in a free oscillating motion by the medium itself and the free oscillating motion is limited by means of stops to the pivoting angle.

* * * * *